United States Patent [19]

Shimizu

[11] Patent Number: 4,460,187

[45] Date of Patent: Jul. 17, 1984

[54] ROLLER SKI HAVING A BRIDLE

[76] Inventor: Key Shimizu, 1084, Kashio-cho, Totsuka-ku, Yokohama City, Kanagawa Prefecture, Japan

[21] Appl. No.: 307,662

[22] Filed: Oct. 1, 1981

[30] Foreign Application Priority Data

Oct. 4, 1980 [JP] Japan ..... 55-138888

[51] Int. Cl.[3] ..... A63C 17/04

[52] U.S. Cl. ..... 280/11.1 BT; 280/11.2; 280/87.04 A

[58] Field of Search ..... 280/11.1, 11.1 R, 11.1 BT, 280/11.1 BR, 11.1 ET, 11.18, 11.2, 11.22, 11.28, 11.3, 87.04 A

[56] References Cited

U.S. PATENT DOCUMENTS

| | | | |
|---|---|---|---|
| 1,467,453 | 9/1923 | Remacle | 280/87.04 A |
| 2,819,907 | 1/1958 | Thoresen | 280/87.04 A |
| 4,040,639 | 8/1977 | Scardenzan | 280/87.04 A |
| 4,076,265 | 2/1978 | Eash | 280/87.04 A |
| 4,168,076 | 9/1979 | Johnson | 280/87.04 A |
| 4,289,325 | 9/1981 | Whitacre | 280/87.04 A |

FOREIGN PATENT DOCUMENTS

| | | | |
|---|---|---|---|
| 558416 | 8/1923 | France | 280/11.1 R |
| 100215 | 8/1975 | Japan . | |
| 147511 | 10/1978 | Japan . | |
| 196583 | 7/1967 | U.S.S.R. | 280/11.1 BT |

*Primary Examiner*—David M. Mitchell

*Attorney, Agent, or Firm*—Wenderoth, Lind & Ponack

[57] ABSTRACT

A pair of roller skis, each roller including an elongated plate having a cambered front end, a pivotally mounted front wheel spring biased to maintain rotation in the longitudinal direction of the ski, and a pair of coaxial rear wheels. The elongated plate extends rearward of the rear wheels and mounted thereto is a break head. The top of the cambered front end of the elongated plate of each ski is fixed to opposite ends of a bridle to be held by the rider of the ski for improved control of the skis.

4 Claims, 8 Drawing Figures

ROLLER SKI HAVING A BRIDLE

BACKGROUND OF THE INVENTION

This invention relates to improvements in sporting goods, and more particularly in a roller ski having a bridle for traveling or gliding on a declivity or the flat ground.

In addition to skis used for traveling or gliding over snow, some gliding instruments having a pair of ski-like plates with rollers thereunder for use on the ground have been proposed.

The conventional ski is adapted to travel or glide on snow by means of reduced frictional resistance only between the ski and snow, while being controlled by a pair of sticks and edges of the ski as well as a movement of the body of a skier.

On the other hand, the conventional ski-like gliding instrument for use on the ground (hereinafter referred to as roller skis) comprises a pair of comparatively long plates, each having some wheels provided with a long wheel base therebetween, and it is intended that the wheels decrease the frictional resistance encountered by the skis. However, no consideration has been given to controlling the gliding movement or speed.

The movement of the ordinary snow ski can be controlled by a pair of sticks and kinetic balance of the body of a skier, thus increasing enjoyment of skiing as well.

The wheel base between the front rollers and the rear rollers is so long that it is difficult to glide easily and smoothly by controlling kinetic direction as can be accomplished with a roller skate or a snow ski. In addition, it is almost impossible to adjust the speed of the roller ski without any brake or other speed arresting device. According to the conventional roller ski, a pair of shoes of the user is fixedly mounted on the skis respectively, at some potential danger to the user.

A principal object of this invention is to provide roller skis including a pair of long, slender pieces of hard wood combined by a bridle with each other, each hard wood having rollers and a brake for use on a declivity whereby a rider can travel or glide safely and smoothly by manipulating the bridle.

Another object of this invention is to provide roller skis including a bridle whereby a user can control his course by manipulating the bridle.

Another object of this invention is to provide roller skis including brakes whereby the speed of the roller skis can be controlled as desired.

Another object of this invention is to provide roller skis including a bridle whereby a user can wear, or precisely ride on the skis by merely putting his feet on the hard wood pieces without fixing them thereto, and can hop off easily from the hard wood pieces to avoid a possible danger.

A further object of this invention is to provide roller skis which include a bridle, whereby a user or rider can assume a proper posture by controlling the bridle.

A still further object of this invention is to provide a device suitable for the aforementioned purposes which will be comparatively simple in construction and at the same time desirably rigid, strong and durable.

BRIEF DESCRIPTION OF DRAWINGS

While I have shown in the accompanying drawings, a preferred embodiment of my invention, it should be understood that the same is susceptible of modification and change without departing from the spirit of my invention.

DETAILED DESCRIPTION

Figure 1:
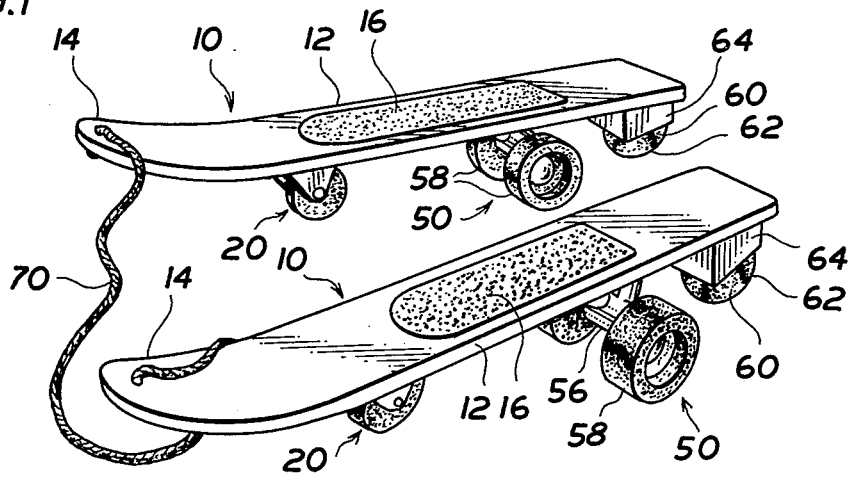
FIG. 1 is an enlarged perspective view of an embodiment of a roller ski including a bridle, as contemplated in a preferred embodiment of this invention.

Referring to the accompanying drawings, a preferred embodiment which has been selected to illustrate this invention comprises a pair of long, slender pieces of hard wood or plastic plate 10 having a cambered taper or boat-shaped top portion 14. A nonskid agent 16 is provided on a base portion 12 upon which a foot is put. A reinforcing plate 18 is integrally fixed to a bottom of the base portion 12 of the plate 10.

A pivot bearing 22 having a vertical coupler opening 24 is fixed to a central front portion of the bottom of the reinforcing plate 18, and a bracket 28 is rotatably mounted to the pivot bearing 22 by means of a flanged pivot 26 held to the vertical coupler opening 24. A plurality of ball bearings 36 are so introduced in a row in an annular ring-shaped race 34 defined between the pivot bearing 22 and a support plate 30 of the bracket 28 at the flanged pivot 26 as its center so that these ball bearings 36 may be subjected to thrust.

A horizontal opening 32 is provided at a lower portion of the bracket 28 rearward of the central longitudinal axis of the pivot 26. Into the horizontal opening 32 is inserted a shaft 38, to which a front wheel 20 is rotatably mounted.

A tension spring 42 is stretched between a rear end portion 40 of the support plate 30 of the bracket 28 and a pin 44 fixed to and extending vertically from the reinforcing plate 18 in order to urge the front wheel 20 into a longitudinal direction of the wood 10.

Figure 5:
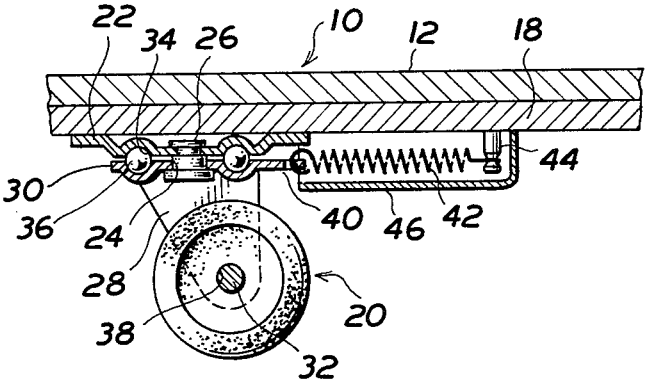
FIG. 5 is a partial cross sectional view, on an enlarged scale, taken along a line V—V of FIG. 4, particularly showing a rear wheel urged rearwardly by a tension spring.

Alternatively, a pair of tension springs 42 may be mounted parallelly, or an elastic cord may be provided so as to urge the front wheel 20 in a longitudinal proceeding direction. Instead of mounting a tension means, a stopper (not shown) is provided in another embodiment to limit a rotating motion of the bracket 28. In the preferred embodiment as shown in FIG. 5, the pivot 26 is vertically mounted to the hard wood or plastic plate 10. A cover 46 is mounted to the bottom of the reinforcing plate 18 to protect the tension spring 42.

Onto a rear end portion of the bottom of the base portion 12 is integrally provided a base 52, to which a pedestal 54 is fixed through a rubber cushion. A shaft 56 having two rotatable rollers 58 at each end portion, respectively, is fixed to the pedestal 54 to constitute a rear wheel 50.

The distance between the outside faces of the two rollers 58 is greater than the width of the hard wood or plastic plate 10 so that the outer faces of rollers 58 each protrude outside the side edges of the plate 10.

Figure 2:
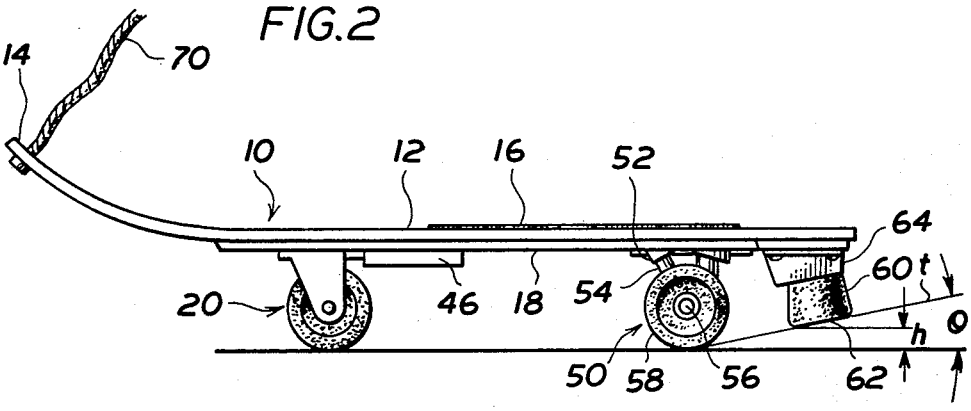
FIG. 2 is a side elevation of the device shown in FIG. 1.
Figure 3:
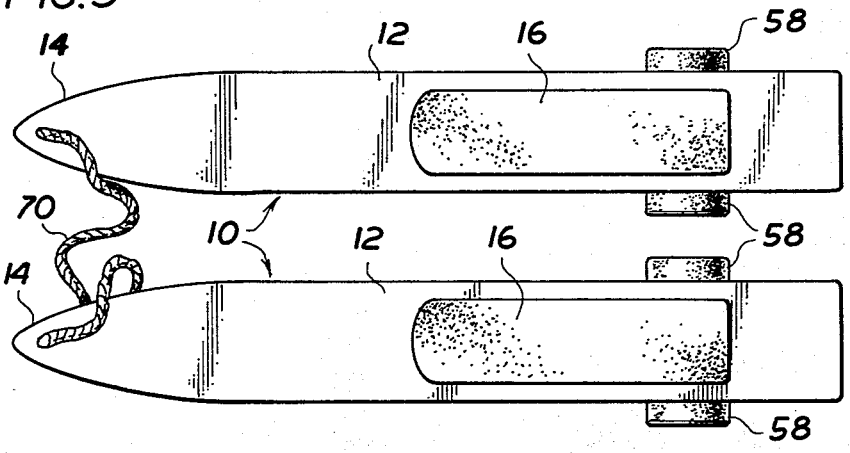
FIG. 3 is a plan view of the device shown in FIG. 1.

The plate 10 and the reinforcing plate 18 are extended rearwards one half to one third of the distance between front wheel 20 and rear wheel 50 from the rear wheel 50. A brake head 60 is fixed to a rear end portion of the bottom of the reinforcing plate 18 by means of a saddle 64. As shown in FIG. 2, the brake head 60 is made of strong wear-resistant material such as hard rubber having a great coefficient of friction.

A distance "h" from a front top portion of the brake head 60 to the ground is so selected as not to come in touch with the latter under normal condition, of use and the frictional surface 62 of the brake head 60 is slanted at an angle $\theta$ to the ground so that the plane thereof is tangent to the rear wheel 58. with this arrangement, a rider 80 may lean her body behind for braking easily and safely with surface 62 flush with the ground.

Both ends of a bridle 70 are firmly fixed at each top end portion of the plates 10. The bridle 70 is long enough for the rider to manage it in her standing posture, while it may be shortened in her crouching posture. The rider can operate the bridle 70 with both hands for loosening or pulling it back.

Figure 6:
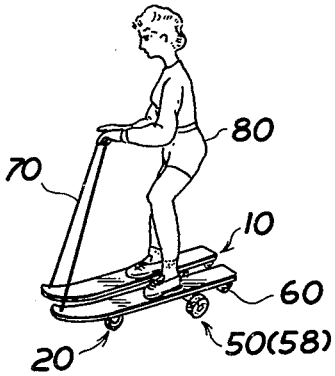
FIG. 6 is a schematic perspective view of the gliding roller ski with a woman rider thereon.
Figure 7:
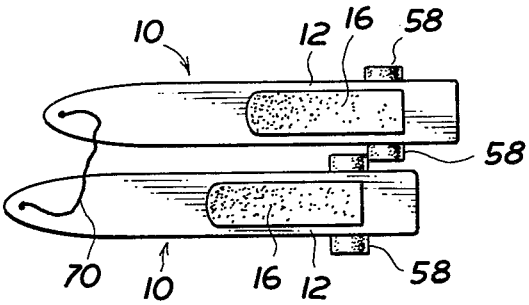
FIG. 7 is a schematic plan view of the roller ski, showing a braking action caused by a contact between the ground and the peripheries of the left and right rear wheels.

FIG. 6 illustrates a woman rider gliding on a pair of the present roller skis on a declivity or slope. The roller skis are adapted to glide on a slope under normal conditions of use. It is possible for the rider to glide on a flat surface by being towed by a bicycle or other vehicles, in which case another rope (not shown) may be connected to a top portion of the bridle 70. In such a standing posture, the rider can exercise by gripping the bridle 70 so as to effectively acquire balance and maintain stability even while being towed in a straight driving line.

The rider can easily twist her ankles on the roller skis for turning the direction of the gliding roller skis. With the triwheels comprising the front roller (wheel) 20 and a pair of the rear rollers 58 and the front wheel 20 being rotatable at the pivot 26 as its center, changing the gliding direction can be carried out quite easily. The bridle 70 may facilitate the rider 80 stabilizing her standing posture while changing the gliding direction and also may help her change the top portion of the roller skis sidewards as desired.

Figure 4:
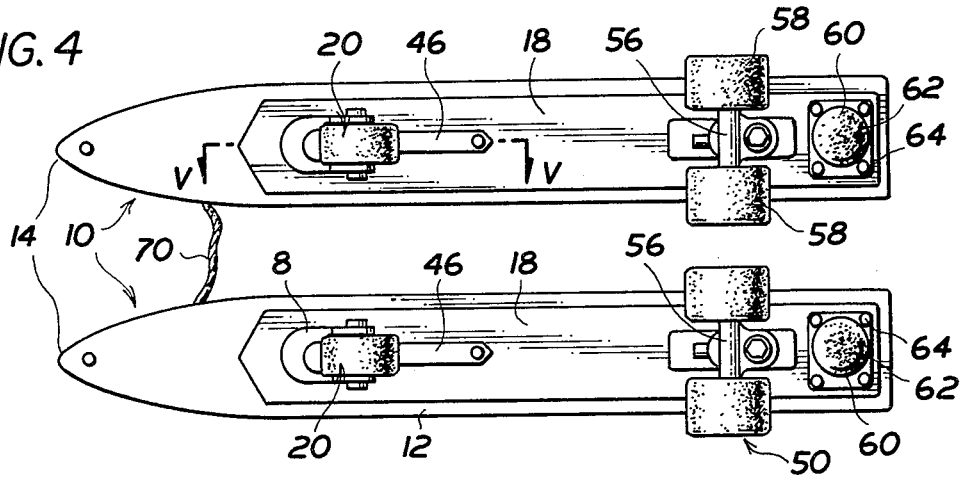
FIG. 4 is a bottom view of the device shown in FIG. 1.

On shifting to straight gliding, the rider can restore each of the parallelly gliding roller skis into their original positions as shown in FIG. 4, with the stabilizing elements of the respective front wheels 20.

Figure 8:
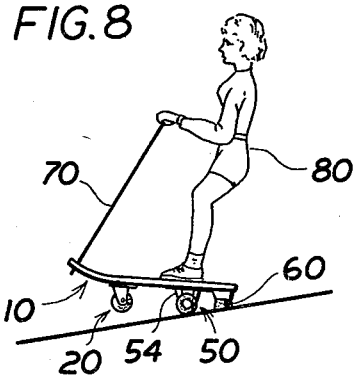
FIG. 8 is a schematic side view of the roller ski being controlled by a rider for braking.

With reference to FIG. 8, each roller ski is being controlled for braking by the rider 80. For braking, the bridle 70 is pulled by the hands while the rider's weight is shifted backward so that the pedestal 54 is driven to rotate clockwise about the shaft 56, thus raising the cambered portion 14 upward and also raising the front wheel 20 off the ground. At the same time, the frictional surface 62 of the brake head 60 is brought into contact with the ground to arrest the gliding movement of the roller ski. This braking posture can be carried out without the bridle 70, but with the assistance of the bridle, the braking can be effected quite safely.

In practice, either of the right or left plates 10 is braked to decrease the gliding speed as desired and subsequently stopped. During high speed gliding, the inertial force of the rider 80 is so strong that the rider is liable to lean forwards. When the bridle 70 is pulled back and the rider 80 leans backward, it is possible for the rider to avoid forward tumbling.

On returning to straight gliding, the rider can control her direction by pulling the bridle 70. When one or both of the top portions of the roller ski are undesirably widening during straight gliding, the rider 80 can narrow them to correct the problem by twisting her ankles together with her gripping bridle 70.

With increasing speed, the rider may make the outer periphery of the inner rear roller 58 of one ski come into contact with that of the other ski so that the two contacting rollers rotating in the same direction may be subjected to braking.

In addition, the bridle 70 may help avoid backward tumbling of the body of the rider 80. The stronger the backward tumbling force, the stronger the braking force.

For ordinary gliding, the rider can lean forward a little while the pedestal 54 is driven to rotate clockwise about the shaft 56 to make the frictional surface 62 come in contact with the ground.

The roller skis of this invention comprise triwheels so as to have a strong load capacity and also to distribute the load properly. The rider can glide not only on a declivity but also on an inclined grassy lawn which is used as a skiing ground in winter. The triwheeled roller ski in accordance with this invention does not give too much load to the ankles of the rider, thus enabling the rider to manipulate the roller skis quite easily.

With the provision of triwheels, bridle and brake head, it is possible to glide, turn and brake effectively, easily and safely. Accordingly, the roller ski of this invention provides a recreational device which can be enjoyed by many people including children and adults.

While an embodiment of the invention has been described, it is obvious that variations and modifications are possible without departing from the invention. It is desired to cover all such forms of the invention as would be apparent to one skilled in the art, and which come within the scope of the appended claims.

I claim:

1. A pair of roller skis, each ski comprising:

a longitudinally extending long slender plate having a cambered front end and a base portion behind said front end; said base portion having a front portion adjacent said cambered front end and a rear portion behind said front portion;

a nonskid agent located on said base portion for receiving thereon a foot of a rider;

a reinforcement plate fixed to the bottom of said base portion;

a pivot bearing having a vertical coupler opening, fixed to said reinforcement plate at said front portion longitudinally spaced from said cambered front end;

a bracket and a flanged pivot held in said vertical coupler opening, said bracket being mounted to said pivot bearing by said flanged pivot, said bracket having a horizontal opening at a lower portion thereof extending transversely of said longitudinal direction rearward of said vertical coupler opening;

a support plate fixed to said bracket, said support plate and said pivot bearing defining a horizontal ringshaped race therebetween surrounding said flanged pivot;

a plurality of ball bearing filling said race so as to be subject to thrust;

a front shaft received in said horizontal opening and a front wheel rotatably mounted on said front shaft;

a support member extending vertically downward from said reinforcement plate rearward of said support plate;

a tension spring stretched between a rear end of said support plate and said support member so as to urge said front wheel into a vertically and longitudinally extending plane;

a cover mounted to said reinforcement plate so as to enclose said tension spring;

a base fixed to said base portion beneath said base portion rearward of and longitudinally spaced from said front wheel;

a resilient cushion fixed to said base beneath said base;

a pedestal fixed to said cushion beneath said cushion;

a rear shaft having two rotatable rear rollers at each end thereof mounted to said pedestal, said rear shaft and said two rear rollers constituting a rear wheel having outer wheel surfaces separated by a first distance greater than the width of said said long slender plate; said long slender plate and said reinforcement plate extending rearward of said rear wheel a second distance of between one third and one half of the longitudinal distance between said front wheel and said rear wheel; and a saddle fixed to said reinforcement plate beneath said reinforcement plate rearward of said rear wheel, and a brake head fixed to said saddle beneath said saddle.

2. A pair of roller skis as in claim 1, wherein said brake head is made of strong wear-resistant material such as hard rubber having a great coefficient of friction and vertically spaced above the bottom of said rear wheels so as not to come in touch with the ground when said front wheel and said rear wheel are engaging the ground, and has a frictional surface slanted so that the plane thereof is tangent to said rear wheel.

3. A pair of roller skis as in claim 1, further comprising a bridle firmly fixed at the ends thereof to the top end of said cambered front end of separate ones of said pair of skis.

4. A pair of roller skis as in claim 1, wherein each ski comprises a pair of tension springs mounted parallelly so as to urge said front wheel in a longitudinally proceeding direction.

* * * * *